US012692776B2

(12) United States Patent
Cook et al.

(10) Patent No.: US 12,692,776 B2
(45) Date of Patent: Jul. 28, 2026

(54) CONTINUOUS SANDING OPERATION FOR A HYDRAULIC FRACTURING SYSTEM

(71) Applicant: FMC Technologies, Inc., Houston, TX (US)

(72) Inventors: James Cook, Houston, TX (US); Corey Massey, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 19/018,103

(22) Filed: Jan. 13, 2025

(65) Prior Publication Data

US 2026/0201784 A1 Jul. 16, 2026

(51) Int. Cl.
*E21B 43/26* (2006.01)
*E21B 43/267* (2006.01)

(52) U.S. Cl.
CPC ..... *E21B 43/2607* (2020.05); *E21B 43/267* (2013.01)

(58) Field of Classification Search
CPC ..... E21B 43/2607; E21B 43/26; E21B 43/017
See application file for complete search history.

(56) References Cited

U.S. PATENT DOCUMENTS 9,903,190 B2 2/2018 Conrad et al.
11,506,032 B1 * 11/2022 Fisher ..... E21B 43/2607
11,585,197 B2 * 2/2023 Mazrooee ..... F04B 49/08
11,598,191 B2 * 3/2023 Fripp ..... E21B 43/26
11,808,126 B2 11/2023 Cook et al.
11,959,358 B2 * 4/2024 Beason ..... E21B 43/2607
12,060,783 B2 8/2024 Krupa et al.
12,065,919 B2 * 8/2024 Warner ..... E21B 47/06
12,120,202 B2 * 10/2024 Wang ..... E21B 43/26
12,281,557 B1 * 4/2025 Warren ..... E21B 43/267
12,378,861 B2 * 8/2025 Christie ..... E21B 43/2607
12,454,882 B1 * 10/2025 Warren ..... E21B 43/2607
2021/0310346 A1 10/2021 Bull et al.
2024/0392672 A1 11/2024 Krupa et al.
2025/0116180 A1 * 4/2025 Drews ..... E21B 43/26
2025/0320802 A1 * 10/2025 Warren ..... B01F 35/714

OTHER PUBLICATIONS

PCT Patent Application PCT/US2025/55246 International Search Report and Written Opinion of the International Searching Authority issued Mar. 30, 2026.

* cited by examiner

*Primary Examiner* — Kenneth L Thompson
(74) *Attorney, Agent, or Firm* — Erise IP, P.A.

(57) ABSTRACT

Systems, methods, and devices for continuous sanding operations of a hydraulic fracturing system, in which one or more dedicated pumps are used to continuously pump fracturing slurry into at least one well and seamlessly switch between a plurality of wells. One or more ancillary pumps may be included to pump ancillary fluid and performed ancillary operations on other wells while the dedicated pump is pumping slurry on the at least one well.

20 Claims, 7 Drawing Sheets

CONTINUOUS SANDING OPERATION FOR A HYDRAULIC FRACTURING SYSTEM

BACKGROUND

1. Field

Embodiments of the present disclosure relate to hydraulic fracturing. More specifically, embodiments of the present disclosure relate to pumping and sanding operations of a hydraulic fracturing system.

2. Related Art

Hydraulic fracturing systems provide sanding operations by injecting a sand-water mixture into a well using one or more pump or pump banks coupled to the well. However, in multi-well systems a number of drawbacks arise when switching sanding operations from one well to the next. Most notably, a number of additional operations may be performed before and after sanding using the same pumps such that sanding operation is stopped while performing said additional operations. Stopping sanding operations leads to a significant amount of downtime and reduction in overall well production efficiency.

SUMMARY

Embodiments of the present disclosure may solve the above-mentioned problems by providing systems, methods, and devices for continuous sanding operation using one or more dedicated pumps to continuously pump fracturing slurry into at least one well and seamlessly switch between a plurality of wells.

In some aspects, the techniques described herein relate to a system for continuous sanding operation in a hydraulic fracturing system, the system including: a plurality of pumps fluidly coupled to a plurality of wells of the hydraulic fracturing system, the plurality of pumps including: a first dedicated slurry pump portion including one or more pumps operable to continuously pump fracturing slurry into at least a first portion of the plurality of wells; and a first ancillary pump portion operable to pump one or more ancillary fluids into at least a first portion of the plurality of wells, wherein the first dedicated slurry pump portion pumps the fracturing slurry into a well of the plurality of wells while the first ancillary pump portion simultaneously pumps the one or more ancillary fluids into another well of the plurality of wells.

In some aspects, the techniques described herein relate to a method of continuous sanding operation in a hydraulic fracturing system, the hydraulic fracturing system including: a plurality of wells; and a plurality of pumps fluidly coupled to a plurality of wells of the hydraulic fracturing system, the plurality of pumps including: a first dedicated slurry pump portion including one or more pumps operable to continuously pump fracturing slurry into at least a portion of the plurality of wells; and an ancillary pump portion operable to pump one or more ancillary fluids into the plurality of wells; wherein the method includes: priming a first well of the plurality of wells by using the ancillary pump portion to pump the one or more ancillary fluids into the first well; after priming of the first well, pumping fracturing slurry into the first well using the first dedicated slurry pump portion; and simultaneously, while pumping fracturing slurry into the first well, priming a second well of the plurality of wells by using the ancillary pump portion to pump the one or more ancillary fluids into the second well.

In some aspects, the techniques described herein relate to a method of continuous sanding operation in a hydraulic fracturing system, the method including: priming a first well of a plurality of wells of the hydraulic fracturing system by using an ancillary pump portion of a plurality of pumps of the hydraulic fracturing system to pump one or more ancillary fluids into the first well; after priming of the first well, pumping a fracturing slurry into the first well using a dedicated slurry pump portion of the plurality of pumps; and simultaneously, while pumping fracturing slurry into the first well, priming a second well of the plurality of wells by using the ancillary pump portion to pump the one or more ancillary fluids into the second well.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, where:

Figure 1A:
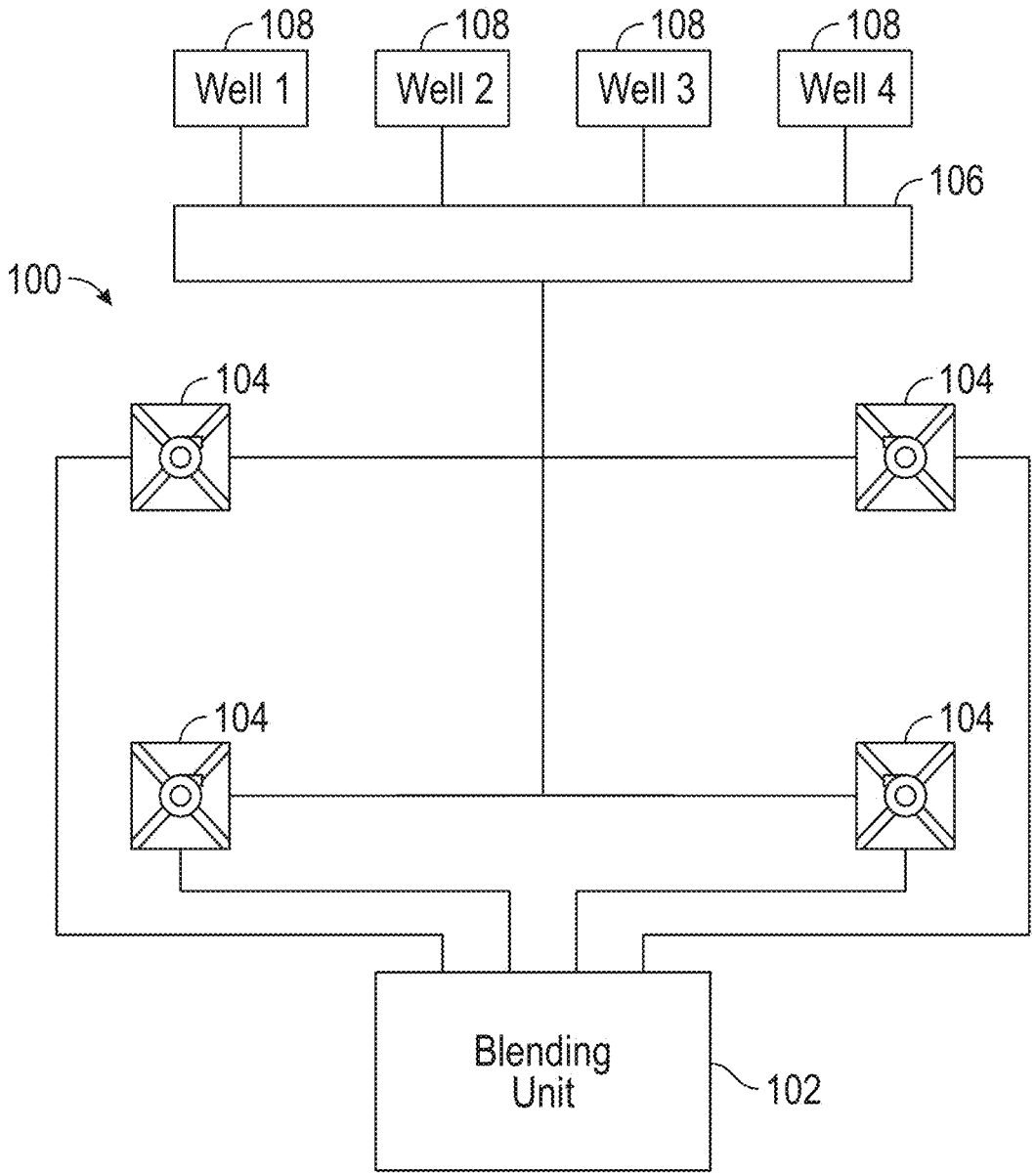
FIG. 1A illustrates an exemplary hydraulic fracturing system.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. Therefore, the following detailed description is not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the technology can include a variety of combinations and/or integrations of the embodiments described herein.

Embodiments of the present disclosure relate to providing systems, methods, and devices for continuous sanding operation within a hydraulic fracturing system. For example, the hydraulic fracturing system may include a plurality of wells, a plurality of pumps or pump banks, and a plurality of manifolds and other fluid connections, as well as a plurality of control devices such as sensors and valves to monitor and direct the hydraulic fracturing process respectively. Embodiments of the present disclosure contemplate dedicating a portion of the plurality of pumps to a distinct process. For example, the plurality of pumps may include a dedicated slurry pump portion dedicated to pumping slurry into a well of the plurality of wells. Embodiments are contemplated in which yet another portion of the plurality of pumps is used for ancillary operations while the dedicated slurry pump portion is used for sanding. Accordingly, in some embodiments, the dedicated slurry pump portion is operable to continuously pump slurry and seamlessly switch between different wells without halting slurry operation.

Slurry or sanding operations, as described herein, may refer to a hydraulic fracturing operation in which a fracturing slurry, such as a sand-water mixture, is pumped into a well to fracture the well. Additionally, or alternatively, embodiments are contemplated in which the fracturing slurry comprises other suitable fluids and proppants, as well as other additives such as chemical additives, which will be described in further detail below.

FIG. 1A illustrates an exemplary hydraulic fracturing system 100 relating to some embodiments of the present disclosure. In some embodiments, the hydraulic fracturing system 100 includes at least one blending unit 102, as shown, such as a blender device or other hydraulic fracturing blender for blending a fracturing slurry or other material for the fracturing process. For example, in some embodiments, the blending unit 102 is configured to blend a slurry including a combination of water and sand or another suitable proppant. The sand, or other proppant, may be injected into a water stream using the blending unit 102 to produce the slurry. In some embodiments, the blending unit 102 is coupled to a blender manifold operable to distribute the slurry to one or more pumps or pump banks of the hydraulic fracturing system 100.

Proppants, as described herein, may include any suitable solid material containing solid particles such as, for example, any of sand, treated sand, or man-made ceramic material, as well as combinations thereof. It should further be understood that other suitable slurry fluids are contemplated in addition to, or in place of water, such as any of gels, foams, compressed gases, or ethylene glycol, as well as combinations thereof. Further still, in some embodiments, the fracturing slurry further comprises one or more additives such as any of chemical additives, acids, biocides, friction reducers, salts, surfactants, or other suitable slurry additives.

In some embodiments, the hydraulic fracturing system 100 includes a plurality of pump banks 104. For example, each pump bank 104 may include at least one pump configured to pump fracturing slurry or another material into one or more portions of the hydraulic fracturing system. In some embodiments, each pump bank 104 is fluidly coupled to at least one manifold 106. For example, the manifold 106 may be fluidly coupled to the plurality of pump banks 104 and a plurality of wells 108. In some embodiments, the manifold 106 includes a plurality of valves operable to selectively isolate one or more wells of the plurality of wells. For example, the manifold 106 may include a valve configuration to isolate a particular well such that fracturing slurry is pumped using one or more of the pump banks into the well.

In some embodiments, each pump bank of the plurality of pump banks comprises a pump assembly as well as a plurality of respective fluid connections, such as fluid connections to the blending unit 102, the manifold 106, and the wells 108. In some embodiments, each pump bank 104 further includes one or more sensors and control devices for monitoring and controlling operation of the pump bank 104. In some embodiments, one or more barrier structures or other structures, as will be described in further detail below.

Many pumping operations described herein are referred to as being performed by pump banks or portions of a plurality of pumps. It should be understood that pump banks and pump portions, as referred to herein may include any of an individual pump or a plurality of pumps. Further, the pumping operations described herein such as pumping of slurry or ancillary fluid may be performed using any combination of individual pumps, single pump banks with multiple pumps, or multiple separate pump banks of multiple pumps or individual pumps. Further still, in some embodiments, the number of pumps and specific arrangement of pumps may be adjusted and/or selected to accommodate the size of a given fracturing operation. For example, the number of individual pumps and pump banks may be selected based on the number of active wells in the hydraulic fracturing system 100.

Figure 1B:
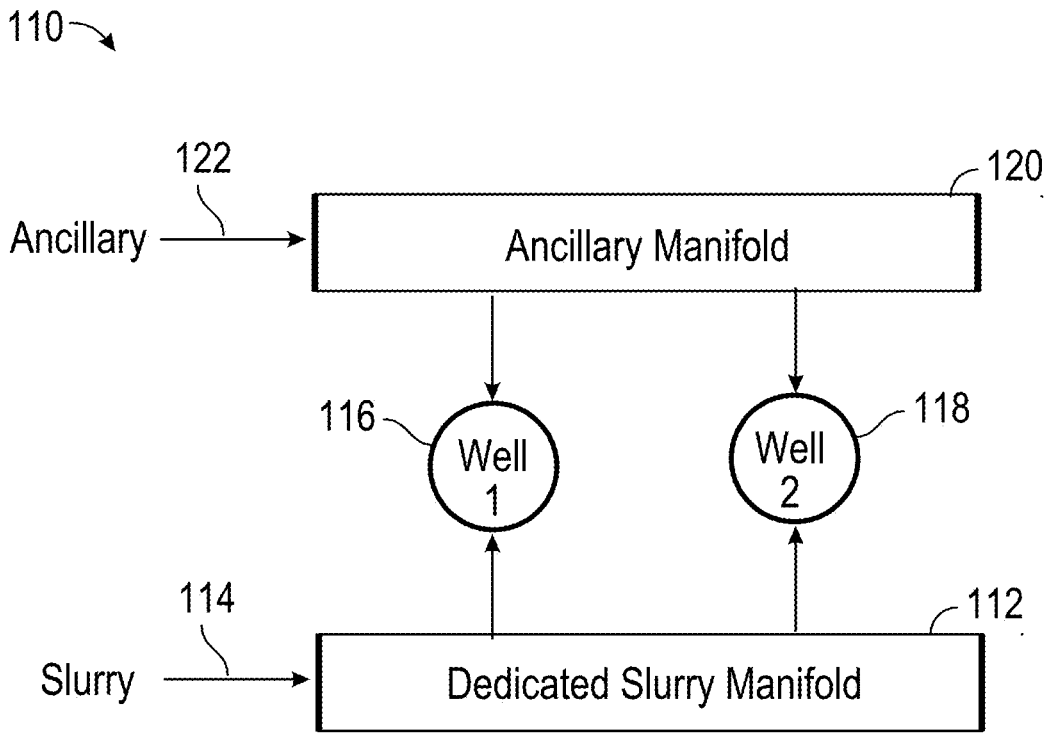
FIG. 1B illustrates an exemplary flex stream layout for the hydraulic fracturing system.

FIG. 1B illustrates an exemplary flex stream layout 110 for the hydraulic fracturing system 100 relating to some embodiments of the present disclosure. In some embodiments, the flex stream layout 110 includes a two or more distinct pump streams. For example, the flex stream layout 110 may include a plurality of individual manifolds designated for specific pumping operations. In some embodiments, the flex stream layout 110 includes a dedicated slurry manifold 112 operable to receive a slurry 114 and selectively route the slurry 114 to respective wells. For example, in some embodiments, the slurry manifold is fluidly coupled to a plurality of wells including a first well 116 and a second well 118, as shown. In some embodiments, the slurry manifold 112 includes or is coupled to a plurality of control valves operable to selectively isolate the slurry 114 to a particular well. For example, the control valves may be arranged such that the slurry 114 is pumped into the first well 116 while the slurry 114 is prevented from flowing to the second well 118, or vice versa.

In some embodiments, the flex stream layout 110 includes an ancillary manifold 120 operable to receive at least one ancillary fluid 122 and selectively route the ancillary fluid 122 to respective wells of the hydraulic fracturing system 100. In some embodiments, the ancillary fluid includes any of water, acid, cleaning solution, or combinations thereof, as well as other fluids used for ancillary and auxiliary purposes aside from primary fracturing slurry. The ancillary manifold 120 is fluidly coupled to the first well 116 and the second well 118, as shown, such that ancillary fluid 122 may be pumped selectively into a particular well. For example, similar to the dedicated slurry manifold 112, the ancillary manifold 120 may include, or be coupled, to one or more control valves operable to selectively allow pumping of the ancillary fluid 122 into a specific well while preventing flow to another well.

In some embodiments, the ancillary fluid 122 includes one or more non-fluid items or substances. For instance, in some embodiments, pellets such as diverter pellets are pumped into the well. For example, the diverter pellets may be used to seal perforations in the well formation of a well. Further, in some embodiments, other fracturing equipment may be pumped using the ancillary manifold and ancillary pumps. For example, the ancillary manifold 120 may be used to direct ancillary equipment such as darts or balls down hole. Said darts or balls, for example, may be used to shift sliding sleeves of the well system. In some embodiments, other ancillary equipment not explicitly described herein may be pumped with the ancillary pumps and directed with the ancillary manifold 120 to perform other ancillary operations. As such, it should be understood that, in some embodiments, the ancillary equipment described herein may be used to pump any combination of fluid substances, non-fluid material, and ancillary equipment, as well as other suitable substances and items not explicitly described herein. In some embodiments, the ancillary and auxiliary operations, as referred to herein, include any operation associated with the hydraulic fracturing system aside from the primary slurry and sanding operations.

In some embodiments, acid is injected into a well as an ancillary operation to propagate the well formation. For example, an acid injection operation may occur prior to a slurry operation on a well to propagate the formation before sanding by pumping slurry into the well. Other ancillary operations are also contemplated and described in further detail herein, such as, for example, pumping water or other cleaning solution, flushing, pumping wireline, or pumping other chemicals or substances into the well, as well as ancillary operations associated with removing fluids or equipment from the well.

Embodiments are contemplated in which the flex stream layout 110 provides continuous sanding operation. For example, the flex stream layout 110 may be configured to continuously pump slurry into a well using the dedicated slurry manifold 112 while simultaneously pumping ancillary fluid 122 into another well using the ancillary manifold 120 to perform any of a variety of ancillary operations, such as, for example, cleaning, priming, flushing, padding, acid injection, fluid communication confirmation, and pump down operations. By providing multiple independent manifolds, the flex stream layout 110 may further allow seamless switching between sanding operation on different wells. For example, the dedicated slurry manifold 112 may initially pump slurry into a first well 116 while pumping ancillary fluid into the second well 118, then switching to pumping slurry into the second well 118 and pumping ancillary fluid into the first well 116.

Figure 2:
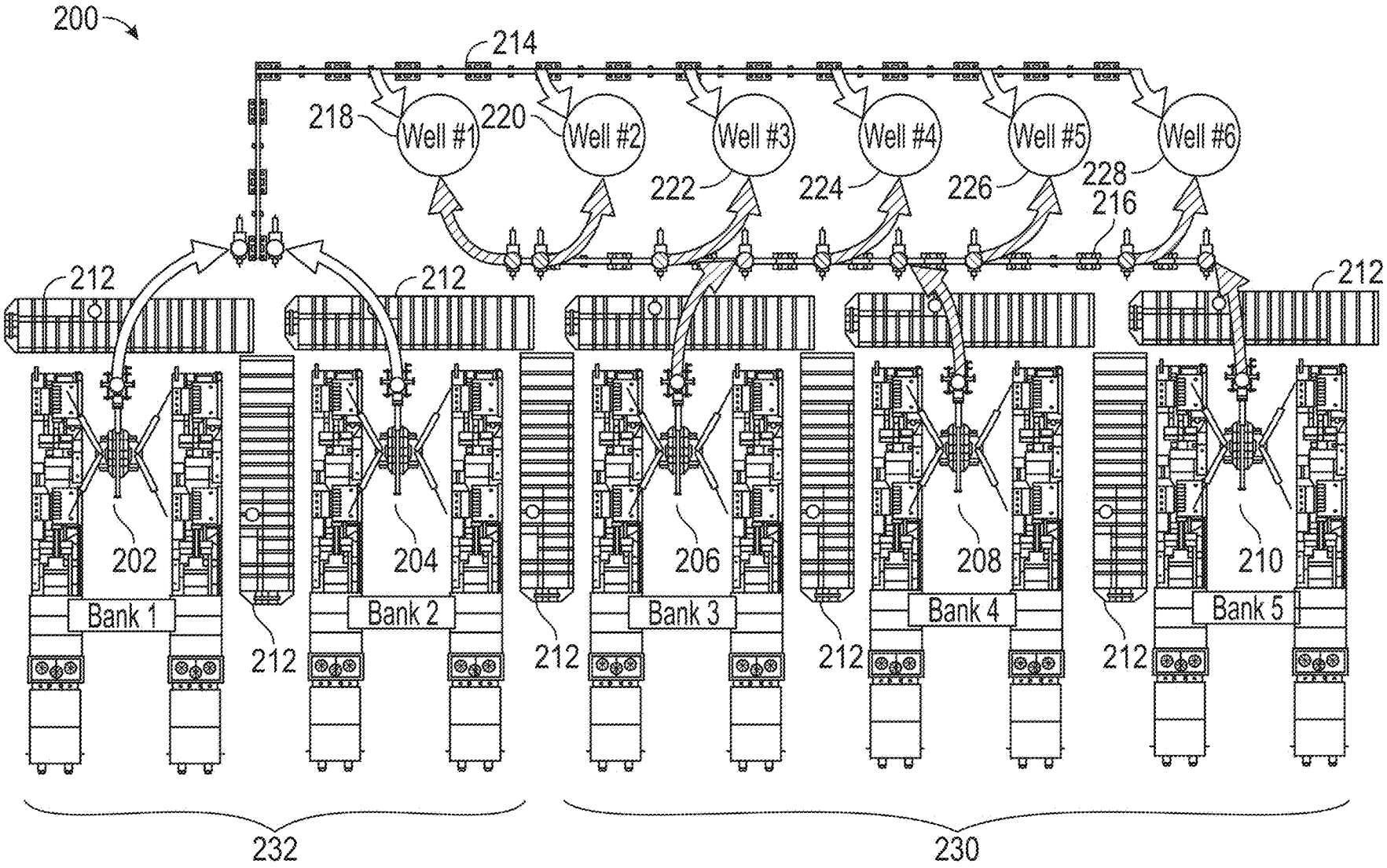
FIG. 2 illustrates an exemplary hydraulic fracturing system layout for single fracturing operation.

FIG. 2 illustrates an exemplary hydraulic fracturing system layout 200 for single fracturing operation relating to some embodiments of the present disclosure. In some embodiments, the hydraulic fracturing system layout 200 employs any combination of the components described above with respect to the hydraulic fracturing system 100 shown in FIGS. 1A-B. For example, the hydraulic fracturing system layout 200 includes the plurality of pump banks 104 including a first pump bank 202, a second pump bank 204, a third pump bank 206, a fourth pump bank 208, and a fifth pump bank 210. However, it should be understood that other pump layouts are also contemplated including different amounts of pump banks, as will be described in further detail below.

In some embodiments, one or more barriers 212 may be included disposed around and between the respective pump banks to provide a shielded safe area. For example, the barriers 212 may provide a safe area for operators to maintenance a respective pump bank during downtime while one or more other pump banks may continue to operate. The barriers 212 may include water tanks operable to provide a structural barrier to contain and isolate high pressure incidents between the pump banks and high-pressure manifolds/connections. In some embodiments, the barriers 212 are selectively moveable and operable to be positioned, for example, using a vehicle. For example, the barriers 212 may be coupled to a trailer portion of a tractor-trailer vehicle assembly. Similarly, in some embodiments, at least a portion of the pump assembly of the pump bank 104 is also selectively moveable. For example, the pump assembly, or portions thereof, may be supported on a trailer portion of a tractor-trailer vehicle assembly.

In some embodiments, the hydraulic fracturing system layout 200 includes an ancillary manifold assembly 214 and a dedicated slurry manifold assembly 216, each independently coupled to a plurality of wells, for example, including a first well 218, a second well 220, a third well 222, a fourth well 224, a fifth well 226, and a sixth well 228. However, it should be understood that similar system layouts are also contemplated for systems with different numbers of wells. In some embodiments, a plurality of fluid connections is provided for each well of the plurality of wells, as shown. For example, in some embodiments, multiple lines are routed to each well or a respective well manifold and each line may be optionally opened or closed through a series of control valves to provide a specific fluid to the well.

In some embodiments, the ancillary manifold assembly 214 is operable to route ancillary fluid to one or more wells of the plurality of wells while the dedicated slurry manifold assembly 216 is operable to route slurry to one or more wells of the plurality of wells. In some embodiments, the hydraulic fracturing system layout 200 includes a dedicated slurry portion 230 of the plurality of pumps fluidly coupled to the dedicated slurry manifold assembly 216 and an ancillary portion 232 of the plurality of pumps fluidly coupled to the ancillary manifold assembly 214. Accordingly, the dedicated slurry portion 230 may be operable to continuously pump slurry into a well of the plurality of wells while the ancillary portion 232 simultaneously pumps ancillary fluid into one or more other wells of the plurality of wells. The plurality of pump banks and system layout further allows seamless switching such that the dedicated slurry portion 230 is able to switch to pumping fluid into another well of the plurality of wells. The hydraulic fracturing system layout 200 includes a layout for a single fracturing system that is operable to pump slurry in a single well at a time. However, it should be understood that other embodiments are contemplated including dual fracturing and multi-fracturing systems capable of pumping slurry into multiple wells at a time, as will be described in further detail below.

In some embodiments, different portions of the hydraulic fracturing system dedicated to specific operations may be optimized for said specific operations. For example, in some embodiments, the components of the pump banks in the dedicated slurry pump portion 230 may be selected to withstand harsh conditions associated with pumping the sand-water mixture. Further, in some embodiments, the components of the ancillary portion 232 may be optimized to pump harsh fluids such as acid. Accordingly, in some embodiments, components of the ancillary portion 232 such as pumps, pump bodies, pump housings, fluid connections and fluid lines may include a corrosion resistant or acid-resistant material to prevent harsh fluids, such as acid, from damaging the components. Further still, embodiments are contemplated in which the maintenance schedules for the pump banks and other portions of the hydraulic fracturing system 100 may be selected or updated based at least in part on the specific operations the components are used for. For example, because the dedicated slurry portion 230 continuously pumps slurry, the maintenance schedule for the dedicated components may be more frequent than portions of the ancillary portion 232 or other components that just pump water or other solutions.

Figure 3:
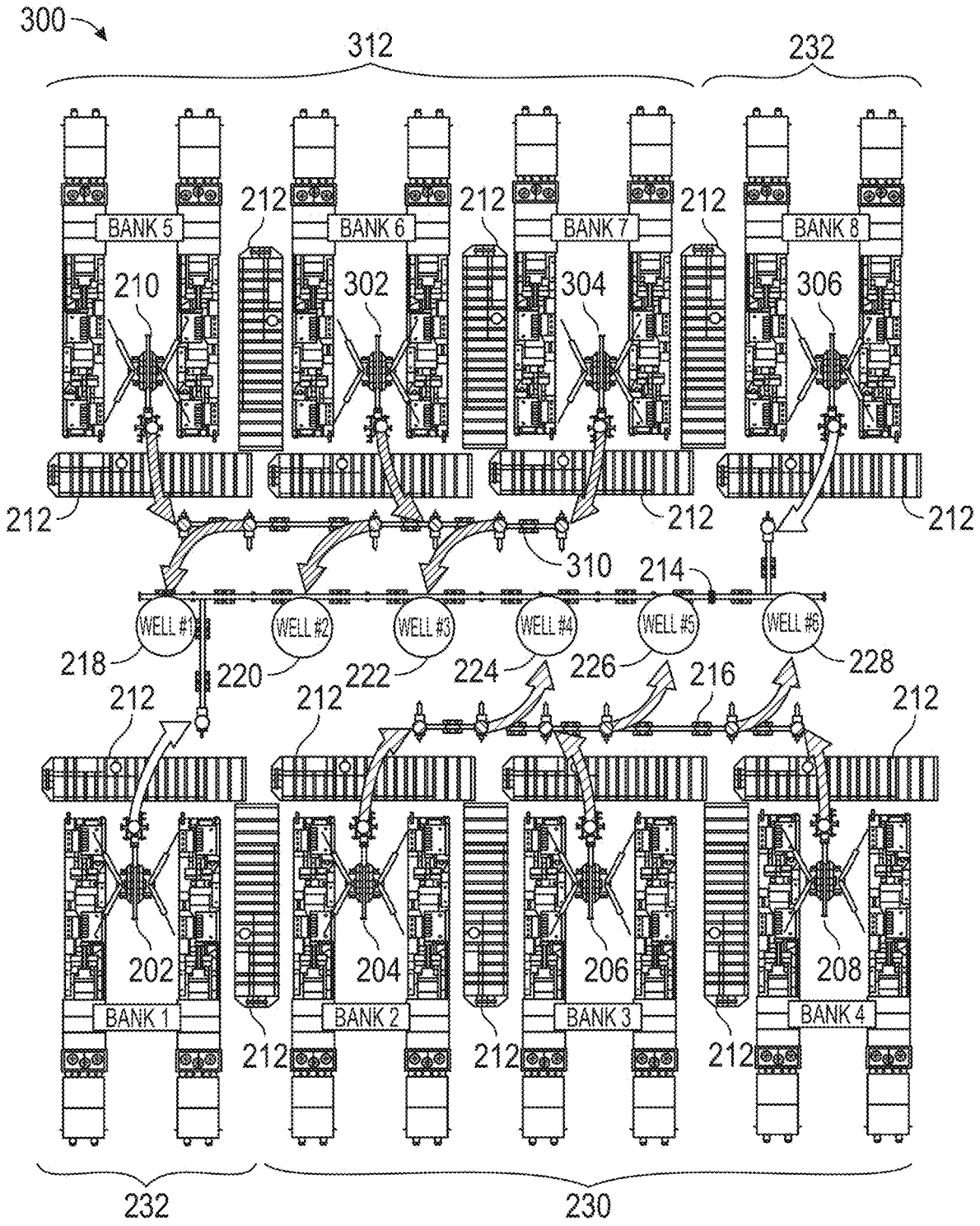
FIG. 3 illustrates another exemplary hydraulic fracturing system layout for dual fracturing operation.

FIG. 3 illustrates another exemplary hydraulic fracturing system layout 300 for dual fracturing operation relating to some embodiments of the present disclosure. The hydraulic fracturing system layout 300 may include components in common with the hydraulic fracturing system layout 200, as described above. For example, in some embodiments, the exemplary hydraulic fracturing system layout 300 includes the first pump bank 202, second pump bank 204, third pump bank 206, fourth pump bank 208, the fifth pump bank 210, the ancillary manifold assembly 214, the dedicated slurry manifold assembly 216, the dedicated slurry portion 230, the ancillary portion 232, and the barriers 212. The hydraulic fracturing system layout 300 may further include additional pump banks, such as a sixth pump bank 302, a seventh pump bank 304, and an eighth pump bank 306.

In some embodiments, the dedicated slurry manifold assembly 216 is operable to pump slurry into a first portion of the plurality of wells. For example, the dedicated slurry manifold assembly 216 may be a first dedicated slurry manifold assembly coupled to the fourth well 224, the fifth well 226, and the sixth well 228. The exemplary hydraulic fracturing system layout 300 further includes a second dedicated slurry manifold assembly 310 operable to route slurry into a second portion of the plurality of wells. For example, the second dedicated slurry manifold assembly 310 may be fluidly coupled to a second portion of the plurality of wells including the first well 218, the second well 220, and the third well 222. The exemplary hydraulic fracturing system layout 300 further includes a second dedicated slurry portion 312, as shown, including the fifth pump bank 210, the sixth pump bank 302, and the seventh pump bank 304. In some embodiments, the ancillary portion 232 includes multiple pump banks. For example, in some embodiments, the ancillary portion 232 includes the first pump bank 202 and the eighth pump bank 306 fluidly coupled to the ancillary manifold assembly 214.

It should be understood that other specific pump layouts in addition to those expressly described herein are also contemplated. For example, the manifolds described herein may be coupled to varying combinations of individual pump banks of the plurality of pump banks compared to those shown and expressly described herein. In some embodiments, other pump and manifold arrangements are contemplated, for example, the dedicated slurry manifold assembly 216 may fluidly couple to at least a portion of the plurality of wells or to all wells. Further in some embodiments, the ancillary manifold assembly 214 is coupled to all wells. Further still, in some embodiments, the dedicated slurry manifold assembly 216 is connected to the first well 218 and the second well 220 while the ancillary manifold assembly 214 is coupled to the third well 222, the fourth well 224, the fifth well 226, and the sixth well 228. However, in some embodiments, other specific arrangements not explicitly shown and described herein are also contemplated. For example, embodiments are contemplated in which either slurry manifold may be connected to as few or as many wells simultaneously. Additionally, in some embodiments, the manifold and pump arrangements may be scaled up to accommodate larger well systems with a greater number of wells. For example, more than two dedicated slurry manifolds may be included, or the number of wells coupled to each dedicated manifold may be increased.

In some embodiments, an exemplary hydraulic fracturing system layout may include additional manifolds. For example, embodiments are contemplated in which three or more separate dedicated slurry manifolds are included. Further, in some embodiments, additional auxiliary manifolds are included, such as two or more. It should be understood that embodiments are contemplated in which any number of dedicated slurry assemblies and any number of ancillary assemblies are included. For example, embodiments are contemplated in which the exemplary hydraulic fracturing system layout 300 includes more dedicated manifold structures and ancillary manifold structure that are not explicitly shown.

Figure 4:
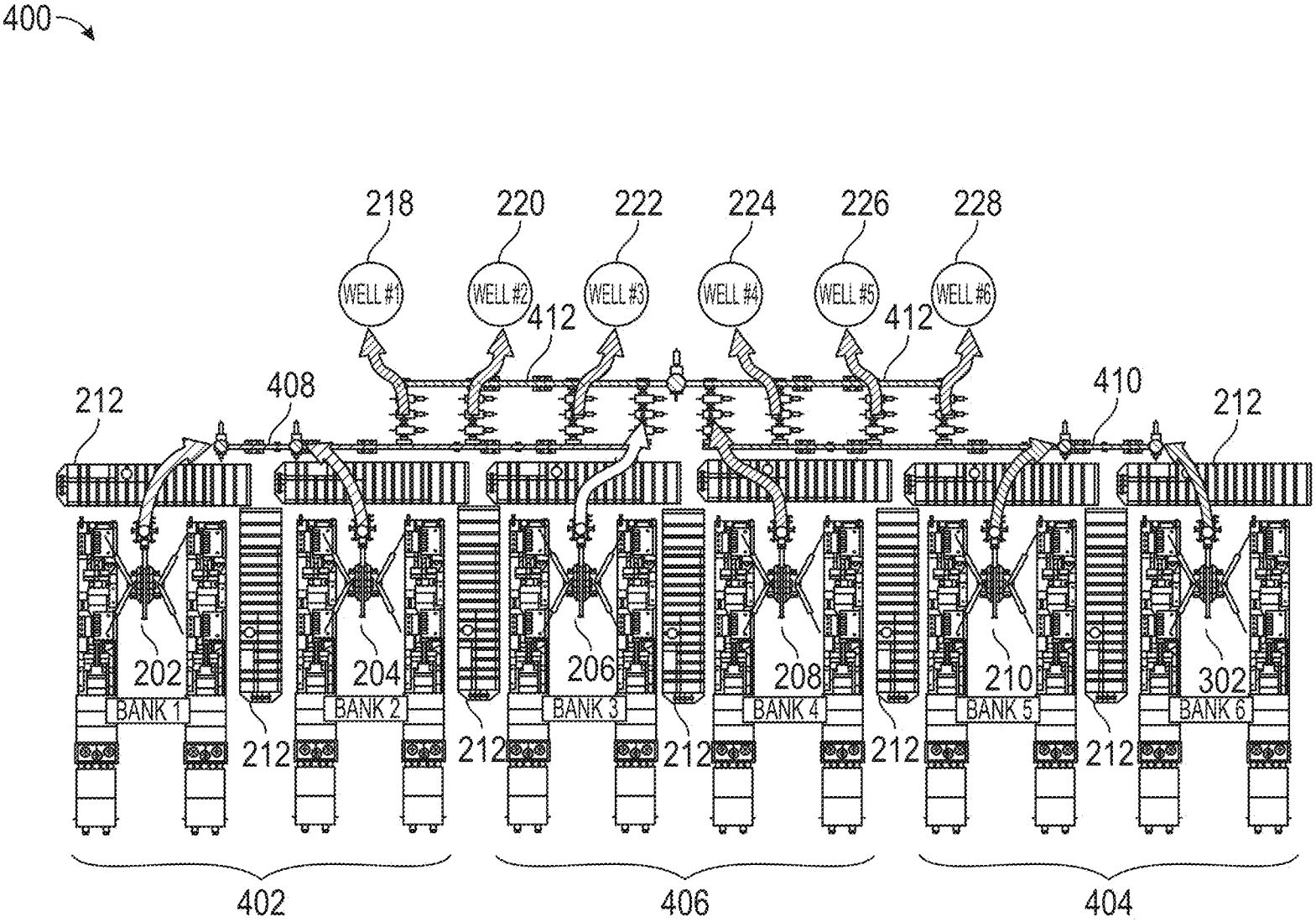
FIG. 4 illustrates yet another exemplary hydraulic fracturing system layout for dual fracturing operation.

FIG. 4 illustrates yet another exemplary hydraulic fracturing system layout 400 for dual fracturing operation relating to some embodiments of the present disclosure. The specific layout shown includes a six-pod arrangement including the first pump bank 202, the second pump bank 204, the third pump bank 206, the fourth pump bank 208, the fifth pump bank 210, and the sixth pump bank 302. In some embodiments, the exemplary hydraulic fracturing system layout 400 includes a first dedicated slurry portion 402 including the first pump bank 202, a second dedicated slurry portion 404 including the fifth pump bank 210 and the sixth pump bank 302, and a switchable portion 406 including third pump bank 206 and fourth pump bank 208.

The switchable portion 406 may be operable to perform any of the ancillary operations described herein, as well as, in some embodiments, to assist in slurry injection along with one of the first dedicated slurry portion 402 or second dedicated slurry portion 404. For example, the one or more pumps of the switchable portion 406 may be configured to pump any of slurry, water, cleaning fluid, acid, or other fluids to the plurality of wells.

In some embodiments, the exemplary hydraulic fracturing system layout 400 comprises one or more dedicated manifolds that are dedicated to routing slurry to a specific portion of wells of the plurality of wells. For example, in some embodiments, the exemplary hydraulic fracturing system layout 400 includes a first dedicated manifold 408 fluidly coupled to the first well 218, the second well 220, and the third well 222. In some embodiments, the hydraulic fracturing system layout 400 further comprises a second dedicated manifold 410 fluidly coupled to the fourth well 224, the fifth well 226, and the sixth well 228. Accordingly, embodiments are contemplated in which portions of the plurality of pump banks are dedicated to pumping slurry for specific portions of the plurality of wells through respective dedicated manifold portions.

In some embodiments, the hydraulic fracturing system layout 400 includes a flex manifold 412. The flex manifold 412 may include a manifold structure that is selectively fluidly coupled to the switchable portion 406, as shown. For example, the flex manifold 412 may be fluidly coupled to the third pump bank 206 and fourth pump bank 208. In some embodiments, each of the first dedicated manifold 408, the second dedicated manifold 410, and the flex manifold 412 include a plurality of control valves operable to optionally allow or prevent fluid flow. Accordingly, valve configurations are contemplated to isolate one or more respective wells of the plurality of wells. For example, one or more control valves of the first dedicated manifold 408 may be opened and closed such that fracturing slurry from the first pump bank 202 and second pump bank 204 is routed to the first well 218 but is prevented from flowing to the second well 220 and the third well 222.

In some embodiments, each of the first dedicated manifold 408 and the second dedicated manifold 410 may include one or more vertical zipper manifold structures. For example, the first dedicated manifold 408 may include a vertical zipper manifold structure including one or more fluid inlets, one or more fluid outlets, and one or more control valve portions. In some embodiments, the one or more fluid inlets include respective fluid connections to each of the first pump bank 202 and the second pump bank 204. In some embodiments, the fluid connections include any combination of flexible jumpers and rigid connections. In some embodiments, the vertical zipper manifold structure vertically isolates portions of the plurality of pump banks. For example, each pump bank may be coupled to a vertical section of the vertical zipper manifold structure such that fluid communication may be allowed or prevented using one or more valves disposed near the vertical section.

Figure 5:
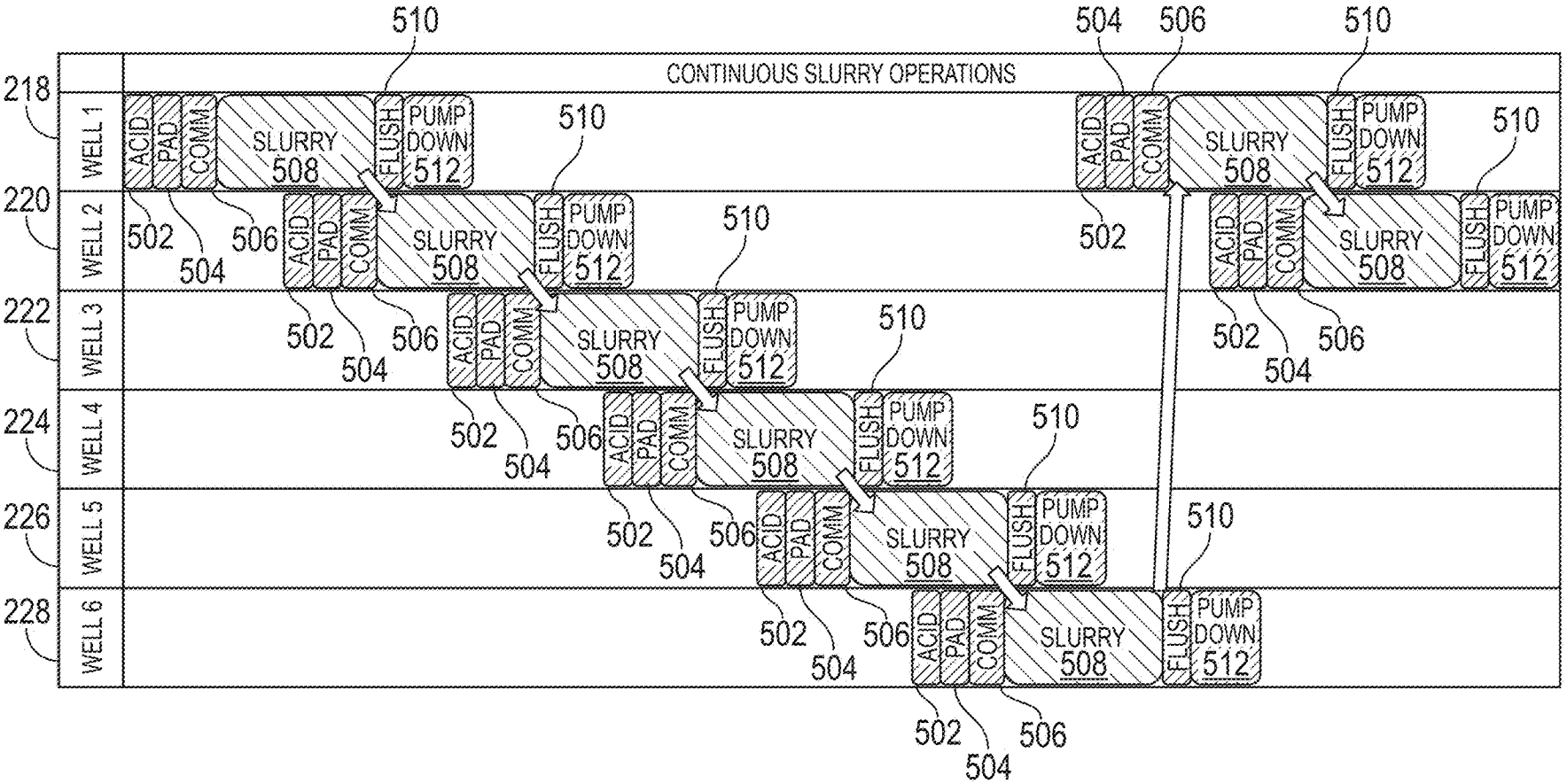
FIG. 5 illustrates an exemplary flow diagram of a method of operation in a hydraulic fracturing system.

FIG. 5 illustrates an exemplary flow diagram of a method of operation in a hydraulic fracturing system relating to some embodiments of the present disclosure and referred to generally herein by reference numeral 500. In some embodiments, the method 500 provides continuous slurry operations within a hydraulic fracturing system such as, for example, any of the hydraulic fracturing system 100 or the hydraulic fracturing system layout 200. The method 500 may employ any combination of the physical structures and components described herein. For example, in some embodiments, steps of the method 500 may be performed on or in relation to specific wells of the plurality of wells including the first well 218, the second well 220, the third well 222, the fourth well 224, the fifth well 226, and the sixth well 228.

In some embodiments, the method 500 is initiated by priming the first well 218. For example, one or more priming operations may be performed prior to pumping slurry into the first well 218, such as, an acid operation 502, a padding operation 504, and a communication confirmation operation 506, as shown. The acid operation 502 may include injection of acid into the well. For example, a portion of the plurality of pump banks such as the ancillary pump portion 232 may be used to pump acid into the well. The padding operation 504 may include injection of water into the well. For example, the ancillary pump portion 232 may be used to pump acid into the well. The communication confirmation operation 506 may be used to confirm fluid communication with the well. For example, said communication confirmation may be based at least in part on a pressure associated with the well. In some embodiments, the communication confirmation operation 506 ensures that the well is accepting fluid prior to pumping slurry.

After priming of the first well 218, the method 500 may include a slurry operation 508 performed on the first well 218 using the dedicated slurry portion 230 of the plurality of pump banks. The slurry operation 508 may include pumping fracturing slurry, such as a sand and water mixture, or another suitable form of slurry fluid described herein, at high pressure into the well.

In some embodiments, while the slurry operation 508 is being performed on the first well 218, priming operations may commence on another well. For example, the acid operation 502, padding operation 504, and communication confirmation operation 506 may be performed on the second well 220 using the ancillary portion 232 simultaneously, while the dedicated slurry portion 230 is used to pump slurry into the first well 218. Accordingly, by simultaneously performing distinct operations on multiple wells, the next well may be primed and ready after slurry operation is completed on the previous well and continuous sanding and slurry operation is provided. For example, after the slurry operation 508 is completed on the first well 218, a subsequent slurry operation 508 is performed on the second well 220 using the dedicated slurry portion 230. In some embodiments, the blending unit 102 operates continuously and does not need to be powered down between slurry operations on different wells.

In some embodiments, while the slurry operation 508 is performed on the second well 220, one or more post-slurry operations may be carried out on the first well 218 using the ancillary portion 232. For example, the one or more post-slurry operations may include any of a flush operation 510 and a pump down operation 512.

In some embodiments, while the slurry operation 508 is performed on the second well 220, one or more priming operations may be performed on yet another well using the ancillary portion 232. For example, in some embodiments, any of the acid operation 502, the padding operation 504, and the communication confirmation operation 506 are carried out on the third well 222 while pumping slurry into the second well 220. In some embodiments, the priming operations on the third well 222 may be performed after the post-slurry operations (i.e., flush operation 510 and pump down operation 512) are completed on the first well 218.

After slurry operation 508 on the second well 220 and priming operations on the third well 222 are completed, slurry operation 508 may be performed on the third well 222, as shown. The continuous sanding/slurry operation described above may be repeated sequentially for each well of the plurality of wells. For example, in a well system with six active wells, slurry pumping may continue sequentially through the six wells. For example, pumping of slurry may seamlessly switch from the first well 218 to the second well 220, from the second well 220 to the third well 222, from the third well 222 to the fourth well 224, from the fourth well 224 to the fifth well 226, from the fifth well 226 to the sixth well 228, from the sixth well 228 to the first well 218, and so on. Similarly, ancillary operations may be repeated sequentially through the plurality of wells to prime the next well of the sequence and to perform post-slurry operations on the previous well.

Figure 6:
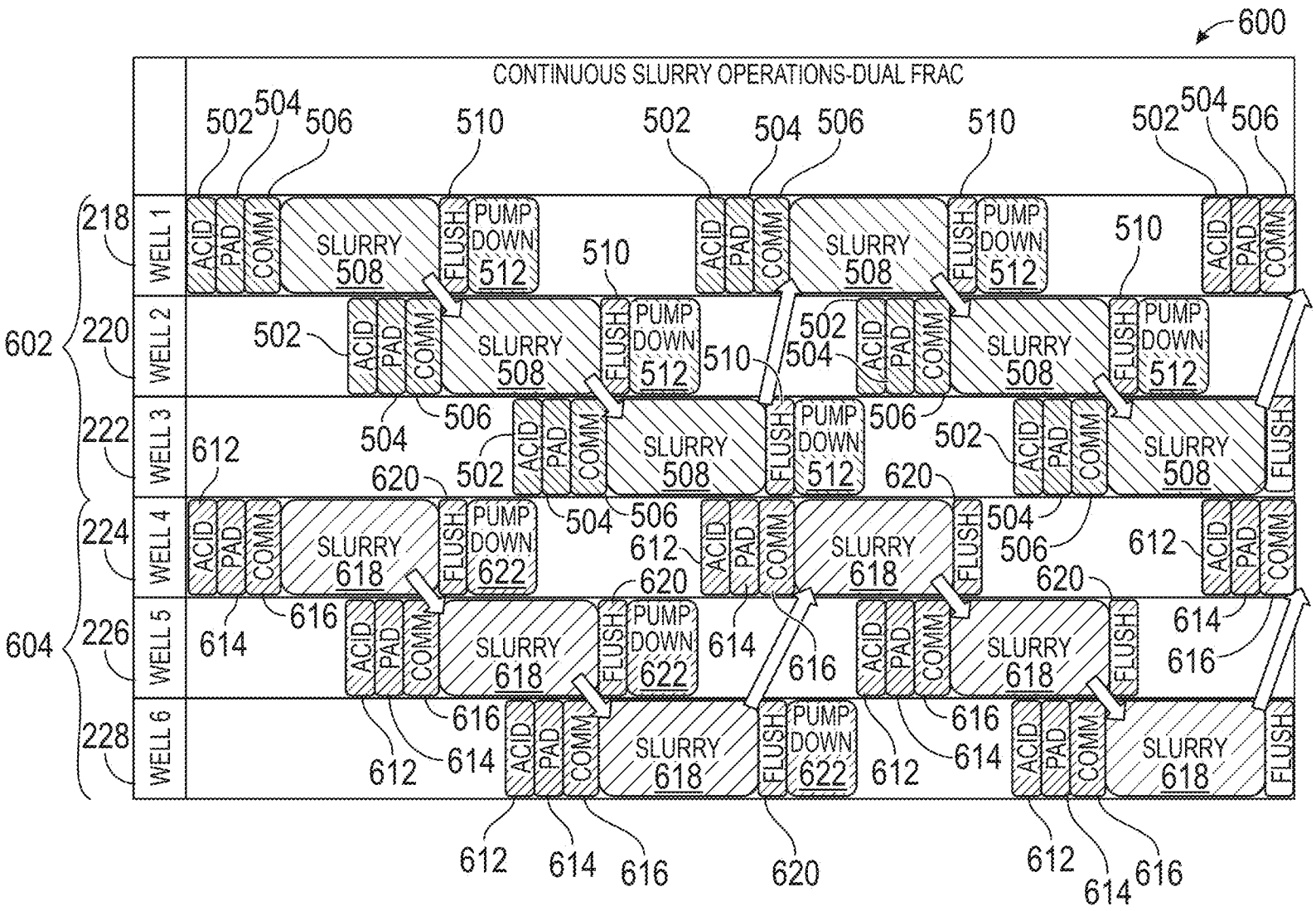
FIG. 6 illustrates an exemplary flow diagram of a method of continuous operation in a dual hydraulic fracturing system.

FIG. 6 illustrates an exemplary flow diagram of a method of continuous operation in a dual hydraulic fracturing system relating to some embodiments of the present disclosure and referred to generally herein by reference numeral 600. In some embodiments, the method 600 provides continuous slurry operations within a dual frac hydraulic fracturing system such as, any of exemplary hydraulic fracturing system layout 300 or exemplary hydraulic fracturing system layout 400. Similar to as described above with respect to the method 500, the method 600 may employ any combination of the physical structures and components described herein. For example, in some embodiments, steps of the method 600 may be performed on or in relation to specific wells of the plurality of wells including the first well 218, the second well 220, the third well 222, the fourth well 224, the fifth well 226, and the sixth well 228.

In some embodiments, the method 600 is performed on a dual frac hydraulic fracturing system in which the plurality of wells is separated into two or more distinct portions. For example, the plurality of well may include a first portion of wells 602 comprising the first well first well 218, the second well 220, and the third well 222 coupled to the first dedicated slurry portion 230 and a second portion of wells 604 comprising the fourth well 224, the fifth well 226, and the sixth well 228 coupled to the second dedicated slurry portion 312.

In some embodiments, the method 600 includes similar operations as described above for sequential operations of the wells 602. For example, the acid operation 502, padding operation 504, communication confirmation operation 506, flush operation 510, and pump down operation 512 may be carried out by the ancillary portion 232 while the slurry operation 508 is performed on another well by the dedicated slurry portion 230. However, the method 600 is carried out within a dual frac system such that additional slurry operations may be performed in parallel on the second portion of wells 604.

In some embodiments, one or more priming operations are performed on the fourth well 224 while the first well 218 is primed. For example, the priming operations may include any combination of an acid operation 612, a padding operation 614, and a communication confirmation operation 616, similar to priming operations 502, 504, and 506 described above. However, in some embodiments, the priming operations performed on the second portion of wells 604 are performed by a second ancillary portion distinct from the ancillary portion 232. Alternatively, in some embodiments, the ancillary operations including priming operations and post-slurry operations are performed on both the first portion of wells 602 and the second portion of wells 604 using the same ancillary portion 232.

In some embodiments, after the priming operations are completed on the fourth well 224, a slurry operation 618 is carried out on the fourth well 224 using the second dedicated slurry portion 312. In some embodiments, the slurry operation 618 is performed in parallel while the slurry operation 508 is performed on a well of the first portion of wells 602, such as the first well 218 using the dedicated slurry portion 230, as shown. However, it should be understood that, in some embodiments, the parallel slurry and ancillary operations may not be aligned and may be staggered apart in time. Further, in some embodiments, slurry operations on different wells may be performed for varying durations of time. As such, in some embodiments, if other ancillary operations are already complete, ancillary pump portions may be employed to assist in slurry operation. Alternatively, or additionally, in some embodiments, if slurry operations are completed for one of the first portion of wells 602 or the second portion of wells 604, the dedicated pumps may be employed to assist in the slurry operation of the other portion of wells.

In some embodiments, simultaneously, while the slurry operation 618 is carried out on the fourth well 224, priming operations may be performed on another well of the second portion of wells 604 using the ancillary pump portion or second ancillary pump portion. For example, the acid operation 612, the padding operation 614, and the communication confirmation operation 616 may be performed on the fifth well 226 while slurry is pumped on the fourth well 224.

After slurry operation 618 is completed on the fourth well 224 and priming operations are performed on the fifth well 226, the slurry operation 618 may be performed on the fifth well 226. In some embodiments, while slurry operation 618 is carried out on the fifth well 226, post-slurry operations may be performed on the fourth well 224. For example, any of a flush operation 620 and a pump down operation 622 may be performed on the fourth well 224 after slurry operation 618 is complete on the fourth well 224. Similar to as described above, with respect to FIG. 5, the sequence of slurry operation and ancillary operation may continue through the plurality of pumps such that slurry is continuously pumped into respective wells, in some embodiments, without stopping operation of the blending unit 102. For example, on the first portion of wells 602, the method 600 may continue with a sanding sequence of the first well 218, the second well 220, the third well 222, then back to the first well and so on, while on the second portion of wells 604, the method 600 continues with a sanding sequence of the fourth well 224, the fifth well 226, the sixth well 228, then back to the fourth well, and so on.

In some embodiments, the slurry operations and ancillary operations on the second portion of wells 604 continue in parallel while similar operations are performed on the first portion of wells 602. Accordingly, embodiments are contemplated in which two parallel sequences of sanding/slurry operations are continuously performed on wells of a dual frac system. It should be understood that similar methods are contemplated for systems with different numbers of wells, such as, for example, two well systems, three well systems, four well systems, and five well systems, six well systems, eight well system, ten well systems, or other well systems with a fewer or greater number of wells not explicitly described herein, as well as for, and including, systems with multi-frac capabilities with two or more sanding operations occurring on different wells simultaneously.

In some embodiments, at least a portion of the steps and operations described herein are automated. For example, in some embodiments, at least a portion of the operations of method 500 or method 600 are performed by one or more control devices. For example, a control system comprising at least one processor may perform steps of the methods by executing computer-readable instructions stored on one or more non-transitory computer-readable media. As a specific example, in some embodiments, the hydraulic fracturing system includes a controller communicatively coupled to the control valves such that one or more of the operations described herein are performed by instructing one or more of the control valves to open and/or one or more of the control valves to close to provide a desired routing of fluid from the pump banks.

In some embodiments, the process of seamlessly switching sanding operations between wells may be at least partially automated. For example, the controller may automatically instruct valves to open and close to isolate a well with respect to the dedicated slurry pump portion such that fracturing slurry is routed to the isolated well based on a predetermined well sequence. Here, for example, the predetermined well sequence may include a sequence of slurry operations throughout at least a portion of the wells in a predetermined order. For example, the predetermined well sequence may provide sanding operations to the first well 218, then the second well 220, then the third well 222, and so on. Further, embodiments are contemplated in which other suitable orders of slurry operations are used.

In some embodiments, one or more operations of the method 500 or method 600 may be performed manually. For example, an operator may manually provide an input to initiate operation on a particular well or switch sanding operation from one well to the next. Further, in some embodiments, a combination of manual and automated operations is contemplated.

The present disclosure shares certain subject matter in common with earlier-filed U.S. Pat. No. 11,808,126, filed Sep. 14, 2021, and entitled "MODULAR MANIFOLD SYSTEM FOR CONTINUOUS FLUID PUMPING INTO A WELL". The aforementioned patent is hereby incorporated by reference in its entirety into the present disclosure. In some embodiments, structures and features described in the aforementioned patent may be employed. For example, in some embodiments, the pump banks described herein may include modular pump manifolds such as those described in the aforementioned patent.

The following embodiments represent exemplary embodiments of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting.

Clause 1. A system for continuous sanding operation in a hydraulic fracturing system, the system comprising: a plurality of pumps fluidly coupled to a plurality of wells of the hydraulic fracturing system, the plurality of pumps including: a first dedicated slurry pump portion including one or more pumps operable to continuously pump fracturing slurry into at least a first portion of the plurality of wells; and a first ancillary pump portion operable to pump one or more ancillary fluids into at least a first portion of the plurality of wells, wherein the first dedicated slurry pump portion pumps the fracturing slurry into a well of the plurality of wells while the first ancillary pump portion simultaneously pumps the one or more ancillary fluids into another well of the plurality of wells.

Clause 2. The system of clause 1, further comprising: a second dedicated slurry pump portion including one or more pumps of the plurality of pumps operable to continuously pump fracturing slurry into a second portion of the plurality of wells distinct from the first portion of the plurality of wells.

Clause 3. The system of clause 2, further comprising: a second ancillary pump portion including one or more pumps of the plurality of pumps, the second ancillary pump portion operable to pump the one or more ancillary fluids into a second portion the plurality of wells, the second portion distinct from the first portion.

Clause 4. The system of clause 1, further comprising: a first dedicated slurry manifold structure providing a fluid path from the first dedicated slurry pump portion to the first portion of the plurality of wells.

Clause 5. The system of clause 4, further comprising: a first ancillary manifold structure providing a fluid path from the first ancillary pump portion to the plurality of wells.

Clause 6. The system of clause 5, wherein the first dedicated slurry manifold structure comprises a plurality of slurry control valves operable to selectively isolate a respective well of the first portion of plurality of wells such that fracturing slurry is routed to the respective well.

Clause 7. The system of clause 6, wherein the first ancillary manifold structure comprises a plurality of ancillary control valves operable to selectively route the one or more ancillary fluids to one or more other wells of the plurality of wells.

Clause 8. A method of continuous sanding operation in a hydraulic fracturing system, the hydraulic fracturing system comprising: a plurality of wells; and a plurality of pumps fluidly coupled to a plurality of wells of the hydraulic fracturing system, the plurality of pumps including: a first dedicated slurry pump portion including one or more pumps operable to continuously pump fracturing slurry into at least a portion of the plurality of wells; and an ancillary pump portion operable to pump one or more ancillary fluids into the plurality of wells; wherein the method comprises: priming a first well of the plurality of wells by using the ancillary pump portion to pump the one or more ancillary fluids into the first well; after priming of the first well, pumping fracturing slurry into the first well using the first dedicated slurry pump portion; and simultaneously, while pumping fracturing slurry into the first well, priming a second well of the plurality of wells by using the ancillary pump portion to pump the one or more ancillary fluids into the second well.

Clause 9. The method of clause 8, further comprising: after pumping fracturing slurry into the first well, performing one or more post-slurry operations using the ancillary pump portion to pump the one or more ancillary fluids into the first well.

Clause 10. The method of clause 9, further comprising: simultaneously, while performing the one or more post-slurry operations on the first well, pumping fracturing slurry into the second well using the first dedicated slurry pump portion.

Clause 11. The method of clause 8, further comprising: simultaneously, while pumping fracturing slurry into the first well, pumping fracturing slurry into a third well of the plurality of wells using a second dedicated slurry pump portion of the plurality of pumps.

Clause 12. The method of clause 11, further comprising: simultaneously, while pumping fracturing slurry into the third well, priming a fourth well of the plurality of wells by using the ancillary pump portion to pump the one or more ancillary fluids into the fourth well.

Clause 13. The method of clause 12, further comprising: selecting a first maintenance schedule for the first dedicated slurry pump portion and the second dedicated slurry pump portion of the plurality of pumps; and selecting a second maintenance schedule for the ancillary pump portion of the plurality of pumps.

Clause 14. The method of clause 12, further comprising: sequentially switching the first dedicated slurry pump portion and the second dedicated slurry pump portion to fluid communication with each well of the plurality of wells without stopping slurry operation of a blending unit of the hydraulic fracturing system.

Clause 15. A method of continuous sanding operation in a hydraulic fracturing system, the method comprising: priming a first well of a plurality of wells of the hydraulic fracturing system by using an ancillary pump portion of a plurality of pumps of the hydraulic fracturing system to pump one or more ancillary fluids into the first well; after priming of the first well, pumping a fracturing slurry into the first well using a dedicated slurry pump portion of the plurality of pumps; and simultaneously, while pumping fracturing slurry into the first well, priming a second well of the plurality of wells by using the ancillary pump portion to pump the one or more ancillary fluids into the second well.

Clause 16. The method of clause 15, further comprising: after pumping fracturing slurry into the first well, performing one or more post-slurry operations using the ancillary pump portion to pump the one or more ancillary fluids into the first well.

Clause 17. The method of clause 16, further comprising: simultaneously, while performing the one or more post-slurry operations on the first well, pumping fracturing slurry into the second well using the dedicated slurry pump portion.

Clause 18. The method of clause 16, wherein the one or more post-slurry operations comprise: a flush operation; and a pump down operation.

Clause 19. The method of clause 15, further comprising: sequentially switching the dedicated slurry pump portion to fluid communication with each well of the plurality of wells without stopping slurry operation of a blending unit of the hydraulic fracturing system.

Clause 20. The method of clause 15, further comprising: confirming fluid communication with the first well prior to pumping the fracturing slurry into the first well.

Although the present disclosure has been described with reference to the embodiments illustrated in the attached drawing figures, it is noted that equivalents may be employed, and substitutions made herein without departing from the scope of the present disclosure as recited in the claims.

Having thus described various embodiments of the present disclosure, what is claimed as new and desired to be protected by Letters Patent includes the following:

1. A system for continuous sanding operation in a hydraulic fracturing system, the system comprising:

a plurality of pumps fluidly coupled to a plurality of wells of the hydraulic fracturing system, the plurality of pumps including:

a first dedicated slurry pump portion including one or more pumps operable to continuously pump fracturing slurry into at least a first portion of the plurality of wells;

a first ancillary pump portion operable to pump one or more ancillary fluids into at least a first portion of the plurality of wells, wherein the first dedicated slurry pump portion pumps the fracturing slurry into a well of the plurality of wells while the first ancillary pump portion simultaneously pumps the one or more ancillary fluids into another well of the plurality of wells;

a blending unit that is operated continuously while switching slurry operation between wells of the plurality of wells; and a first dedicated slurry manifold structure providing a fluid path from the first dedicated slurry pump portion to the first portion of the plurality of wells.

2. The system of claim 1, further comprising:

a second dedicated slurry pump portion including one or more pumps of the plurality of pumps operable to continuously pump fracturing slurry into a second portion of the plurality of wells distinct from the first portion of the plurality of wells.

3. The system of claim 2, further comprising:

a second ancillary pump portion including one or more pumps of the plurality of pumps, the second ancillary pump portion operable to pump the one or more ancillary fluids into a second portion the plurality of wells, the second portion distinct from the first portion.

4. The system of claim 1, wherein the first dedicated slurry pump portion comprises a first maintenance schedule and the first ancillary pump portion comprises a second maintenance schedule distinct from the first maintenance schedule.

5. The system of claim 1, further comprising:

a first ancillary manifold structure providing a fluid path from the first ancillary pump portion to the plurality of wells.

6. The system of claim 5, wherein the first dedicated slurry manifold structure comprises a plurality of slurry control valves operable to selectively isolate a respective well of the first portion of plurality of wells such that fracturing slurry is routed to the respective well.

7. The system of claim 6, wherein the first ancillary manifold structure comprises a plurality of ancillary control valves operable to selectively route the one or more ancillary fluids to one or more other wells of the plurality of wells.

8. A method of continuous sanding operation in a hydraulic fracturing system, the hydraulic fracturing system comprising:

a plurality of wells; and a plurality of pumps fluidly coupled to the plurality of wells of the hydraulic fracturing system, the plurality of pumps including:

a first dedicated slurry pump portion including one or more pumps operable to continuously pump fracturing slurry into at least a portion of the plurality of wells;

an ancillary pump portion operable to pump one or more ancillary fluids into the plurality of wells;

a blending unit; and a first dedicated slurry manifold structure providing a fluid path from the first dedicated slurry pump portion to the plurality of wells;

wherein the method comprises:

priming a first well of the plurality of wells by using the ancillary pump portion to pump the one or more ancillary fluids into the first well;

after priming of the first well, pumping fracturing slurry into the first well using the first dedicated slurry pump portion;

simultaneously, while pumping fracturing slurry into the first well, priming a second well of the plurality of wells by using the ancillary pump portion to pump the one or more ancillary fluids into the second well; and continuously operating the blending unit while switching slurry operation from the first well to the second well.

9. The method of claim 8, further comprising:

after pumping fracturing slurry into the first well, performing one or more post-slurry operations using the ancillary pump portion to pump the one or more ancillary fluids into the first well.

10. The method of claim 9, further comprising:

simultaneously, while performing the one or more post-slurry operations on the first well, pumping fracturing slurry into the second well using the first dedicated slurry pump portion.

11. The method of claim 8, further comprising:

simultaneously, while pumping fracturing slurry into the first well, pumping fracturing slurry into a third well of the plurality of wells using a second dedicated slurry pump portion of the plurality of pumps.

12. The method of claim 11, further comprising:

simultaneously, while pumping fracturing slurry into the third well, priming a fourth well of the plurality of wells by using the ancillary pump portion to pump the one or more ancillary fluids into the fourth well.

13. The method of claim 12, further comprising:

selecting a first maintenance schedule for the first dedicated slurry pump portion and the second dedicated slurry pump portion of the plurality of pumps; and selecting a second maintenance schedule for the ancillary pump portion of the plurality of pumps.

14. The method of claim 12, further comprising:

sequentially switching the first dedicated slurry pump portion and the second dedicated slurry pump portion to fluid communication with each well of the plurality of wells without stopping slurry operation of the blending unit of the hydraulic fracturing system.

15. A method of continuous sanding operation in a hydraulic fracturing system, the method comprising:

priming a first well of a plurality of wells of the hydraulic fracturing system by using an ancillary pump portion of a plurality of pumps of the hydraulic fracturing system to pump one or more ancillary fluids into the first well;

after priming of the first well, pumping a fracturing slurry into the first well using a dedicated slurry pump portion of the plurality of pumps;

simultaneously, while pumping fracturing slurry into the first well, priming a second well of the plurality of wells by using the ancillary pump portion to pump the one or more ancillary fluids into the second well;

continuously operating a blending unit of the hydraulic fracturing system while switching slurry operation from the first well to the second well; and providing, using a first dedicated slurry manifold structure of the hydraulic fracturing system, a fluid path from the dedicated slurry pump portion to the first well of the plurality of wells.

16. The method of claim 15, further comprising:

after pumping fracturing slurry into the first well, performing one or more post-slurry operations using the ancillary pump portion to pump the one or more ancillary fluids into the first well.

17. The method of claim 16, further comprising:

simultaneously, while performing the one or more post-slurry operations on the first well, pumping fracturing slurry into the second well using the dedicated slurry pump portion.

18. The method of claim 16, wherein the one or more post-slurry operations comprise:

a flush operation; and a pump down operation.

19. The method of claim 15, further comprising:

sequentially switching the dedicated slurry pump portion to fluid communication with each well of the plurality of wells without stopping slurry operation of the blending unit of the hydraulic fracturing system.

20. The method of claim 15, further comprising:

confirming fluid communication with the first well prior to pumping the fracturing slurry into the first well.

* * * * *